United States Patent [19]

Bromley et al.

[11] 4,128,989

[45] Dec. 12, 1978

[54] DEEP-DYEING POLYESTER SPINNING PROCESS

[75] Inventors: James E. Bromley; Wayne T. Mowe; Frank Stutz, all of Pensacola, Fla.

[73] Assignee: Monsanto Company, St. Louis, Mo.

[21] Appl. No.: 784,408

[22] Filed: Apr. 4, 1977

[51] Int. Cl.[2] ..... D02G 1/02; D02G 3/02

[52] U.S. Cl. ..... 57/247; 57/284; 57/288

[58] Field of Search ..... 57/140 R, 157 S, 157 TS; 264/210 F

[56] References Cited

U.S. PATENT DOCUMENTS

| | | | |
|---|---|---|---|
| 3,973,386 | 8/1976 | Gorrafa | 57/157 TS |
| 3,977,175 | 8/1976 | Yoshikawa et al. | 57/157 TS |
| 3,996,324 | 12/1976 | Landenberger et al. | 264/210 F X |

*Primary Examiner*—Charles Gorenstein

*Attorney, Agent, or Firm*—Kelly O. Corley

[57] ABSTRACT

Polyester yarn is spun at a sufficiently high speed to produce substantial stress-induced crystallinity and low shrinkage. The resulting feed yarn is textured, yielding a textured yarn which dyes considerably deeper than conventional polyester yarns.

9 Claims, 1 Drawing Figure

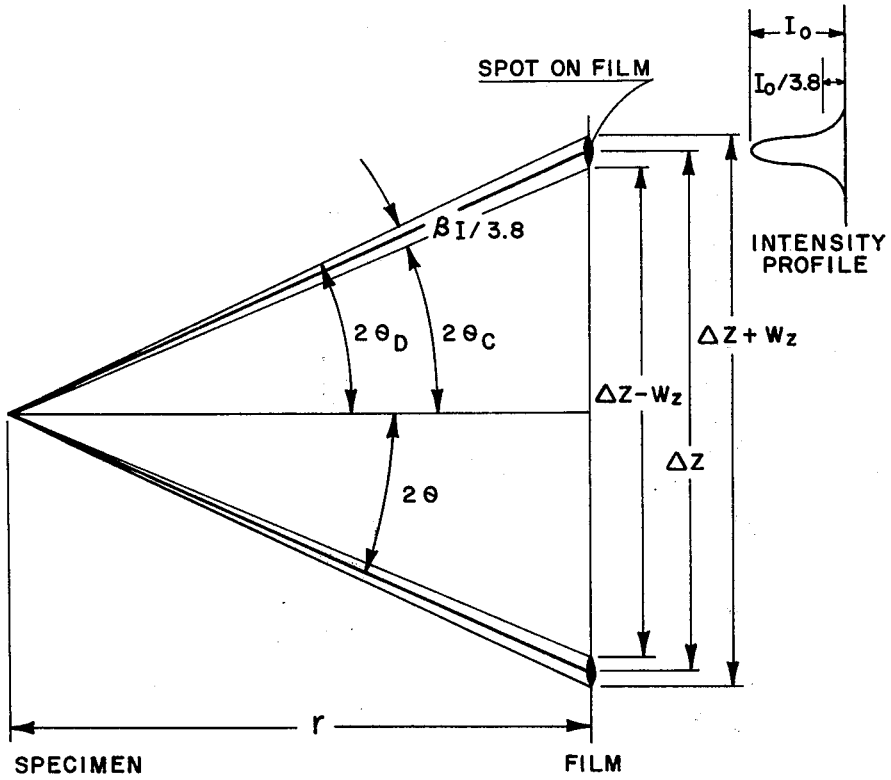
SPOT ON FILM
$I_0$
$I_0/3.8$
INTENSITY PROFILE
$\beta I/3.8$
$2\theta_D$
$2\theta_C$
$\Delta Z + W_z$
$\Delta Z - W_z$
$\Delta Z$
$2\theta$
r
SPECIMEN
FILM

DEEP-DYEING POLYESTER SPINNING PROCESS

The invention relates to a process for producing a deep-dyeing polyester textured yarn, and more particularly to such a process wherein the untextured feed yarn is prepared by providing a minimum amount of stress-induced crystallinity and low shrinkage during spinning of the feed yarn.

The term "polyester" as used herein refers to polymers of fiber-forming molecular weight composed of at least 85% by weight of an ester of a dihydric alcohol and terephthalic acid. To increase the dyeability of polyester yarns and fabrics, it is customary to incorporate additives of various types, such as those disclosed in U.S. Pat. Nos. 3,386,795 to Caldwell; 3,607,804 in Nishimura; and 3,844,714 to McCreath. Such additives are typically expensive and frequently adversely affect the properties of the yarn. Moreover, the mere use of such additives does nothing to improve the productivity of the spinning process.

For making polyester feed yarns for texturing, the process which may be considered to be the industry standard involves spinning polyester at speeds of about 2500–4000 meters per minute, producing a so-called POY (partially oriented yarn) as disclosed in Piazza U.S. Pat. No. 3,772,872 and Langanke U.S. Pat. No. 3,837,156. Commercial practice is believed to be restricted to spinning at about 3000–3500 meters per minute.

It is likewise known to produce polyester flat yarns at spinning speeds in excess of 5200 yards per minute (4750 meters per minute), as disclosed in Hebeler U.S. Pat. No. 2,604,667. Such yarns are intended by Hebeler to be used as-spun, without further processing.

According to the present invention, there is provided a process yielding, as compared to POY processes, a deeper dyeing textured yarn together with increased productivity in the spinning process.

According to the first aspect of the invention, the process comprises texturing a polyester feed yarn having a shrinkage below 30%, an elongation greater than 10% and less than 80%, and a stress-induced crystalline structure having an average crystallite volume of at least $4 \times 10^5$ cubic angstroms, the step of texturing comprising heat-setting the feed yarn at a temperature above 170° C. and below the melt point of the feed yarn while the feed yarn is deformed into a non-linear configuration, and collecting the resulting textured yarn in an orderly fashion.

According to a further aspect of the invention, the feed yarn is drawn while being false-twist heat-set.

According to a further aspect of the invention, the temperature of heat-setting is between 180° C. and 245° C.

According to a further aspect of the invention, the feed yarn has a shrinkage less than 20%, and preferably less than 10%.

According to a further aspect of the invention, the feed yarn has crystalline regions with an average lateral minimum dimension as determined by X-ray diffraction of at least 45 angstroms.

According to another aspect of the invention, the feed yarn has a longitudinal crystallite dimension in the 103 direction of at least 100 angstroms.

According to another aspect of the invention, there is provided a deep-dyeing textured polyester yarn having a crystallite skewness angle between 5° and 35°.

According to another aspect of the invention there is provided a yarn of the above character which has been textured by being false-twist heat-set.

According to another aspect of the invention there are provided yarns of the above characters wherein the skewness angle is between 20° and 30°.

As polyester yarn is spun at increasingly high speeds, a relatively narrow transition speed range is attained wherein the yarn shrinkage in boiling water rather abruptly decreases from high values such as 40–60% to low values such as 10% or less. X-ray analysis shows that the yarn undergoes stress-induced crystallization during this transition speed range, changing from a primarily paracrystalline or microcrystalline structure for yarns spun at typical POY spinning speeds to a stress-induced crystalline structure having an average crystallite volume of at least $4 \times 10^5$ cubic angstroms for yarns spun at speeds above the transition speed range. In one particular case of linear polyethylene terephthalate of normal textile denier per filament and molecular weight spun using a spinneret capillary of 0.38 mm. diameter, the average crystallite volume abruptly increases from less than $3 \times 10^5$ cubic angstroms at speeds up to 5000 yards per minute (4572 meters per minute) spinning speed to $6.8 \times 10^5$ cubic angstroms at 6000 yards per minute (5500 meters per minute) spinning speed; the crystallite dimensions in directions lateral to the yarn axis (the 010, 110, and 100 directions) simultaneously increase from values of about 10 angstroms to values of about 50–65 angstroms. Yarn shrinkage in boiling water drops from about 60% at 4500 yards per minute (4115 meters per minute) to about 5% at 5500 yards per minute (5029 meters per minute).

It is noted that the speed at which the transition range occurs can be shifted somewhat by selection of the spinneret capillary diameter, the denier per filament, and the quenching conditions. For example, linear polyethylene terephthalate spun through a capillary having a diameter of 1.27 mm. has an average crystallite volume of $5.6 \times 10^5$ cubic angstroms when spun at only 4500 yards per minute (4115 meters per minute).

In the spun state (prior to texturing), the yarns dye progressively lighter as spinning speed increases. One would expect lighter dyeing textured yarns to be produced from lighter dyeing feed yarns. It is therefore entirely unexpected that the textured yarns produced from feed yarns spun at speeds above the noted transition speed range dye considerably deeper than textured yarns produced from feed yarns spun at speeds below the transition speed range. Depending on the texturing conditions, the dyeing conditions, dyestuff, type and amount of carrier (if any), the textured yarns according to the invention dye as much as 50% deeper than textured yarns made from yarns spun at intermediate speeds such as 3200–3500 meters per minute.

The stress-induced morphology in the spun state results in novel morphology in the textured state, which is believed to be responsible for the observed deeper dyeing characteristics of the textured yarn according to the invention.

EXAMPLE

Linear polyethylene terephthalate polymer of normal textile molecular weight is extruded downwardly through 34 capillaries of a spinneret, each capillary having a diameter of 15 mils (0.38 mm.) and a length of 30 mils (0.76 mm). The spinning temperature just above the spinneret is 290° C. The molten streams are quenched by horizontally directed air at room temperature and an air velocity of 14 meters per minute in a quench zone just below the spinneret. The solidified filaments are converged into a filament bundle or yarn at a point two meters below the spinneret and pass downwardly about a driven feed roll and its associated separator roll rotating with a peripheral speed of 6000 yards per minute (5482 meters per minute), from which the yarn is fed to a winding mechanism where it is collected in an orderly fashion as a spun yarn having 180 denier an elongation to break of 55%, and 4% shrinkage. The feed roll is located 5 meters below the spinneret. The spun yarn has a crystallite dimension in the 103 direction of about 125 angstroms, crystallite dimensions in directions lateral to the yarn axis of at least 60 angstroms, and an average crystallite volume of $6.7 \times 10^5$ cubic angstroms.

The spun yarn is simultaneously draw-textured at 340 meters per minute and a draw ratio of 1.14 to 1 using a friction false-twist mechanism of the type disclosed in U.S. Pat. No. 3,973,383, a primary heater temperature of 205° C., and a secondary or setting heater temperature of 200° C. The resulting textured yarn is knitted into fabrics and dyed using various dyestuffs. The fabrics dye as much as 50% deeper than fabrics knit from textured POY. X-ray examination of textured yarn according to the invention reveals a crystallite skewness angle between 5° and 35°, typically between 20° and 30°, as compared with textured POY which exhibits skewness angles in excess of 38°–40°. This observed lower skewness angle in yarns according to the invention correlates with the observed deeper dyeing, and is believed to define the internal structural parameter responsible for the deeper dyeing.

TEST PROCEDURES

The following procedures are used to determine the average crystallite dimensions and volumes of polyester feed yarn fibers and the lamellar skewness of polyester draw-textured yarn fibers.

X-Ray Patterns

Wide and small angle X-ray diffraction patterns are obtained using Statton flat film vacuum cameras. Three Kodak No-Screen Medical X-ray films are used in each film cassette: the front film receives the most intense exposure and reveals weak diffraction maxima. The second and third films are successively lighter by factors of about 3.8 and 14.4 and show increasing detail in the strong maxima and provide reference intensities for estimation of crystallite dimensions and other structural parameters. 0.5 mm. diameter pinholes are used with Statton yarn holders, providing a 0.5 mm. thick sheath of mutually aligned yarn filaments. The yarn is wound on to the holder with just enough tension to remove most of the visible crimp in the case of textured yarn. A fine focus copper target X-ray tube (1200 watts maximum load, $0.4 \times 0.8$ mm. spot focus as observed at 6° take-off angle) is used with a nickel beta filter and a take-off angle of 4.5°. Wide angle patterns of the polyester feed yarn fibers are taken with a three inch collimator, 25 minute exposure times, a five centimeter specimen-to-film distance, 40 KV and 26.25 MA (87.5% of the maximum load) under vacuum. Small angle patterns of the polyester draw-textured yarn fibers are taken with a six inch collimator, a 32 centimeter specimen-to-film distance, the same tube loading, sixteen hour exposure times under vacuum.

Average Crystallite Dimensions and Volumes — Wide Angle Patterns

As shown on the drawing, the diameter between diffraction peak centers $\Delta Z$ and widths $W_Z$ at which the intensity has fallen to approximately 1/3.8 of the maximum value are measured for the principal diffraction maxima: 010, 1$\bar{1}$0, 100 and $\bar{1}$03. The next lighter film, lighter by about 1/3.8 is used for intensity references. A bow divider is used to measure these distances. The divider is adjusted to simultaneously fit the width on the darkest film using the second film as a reference, and the width on the second film using the third film as a reference. Occasionally the intensities are such that only one pair of films are useable for a particular maximum. One estimate of the diameter, $\Delta Z$, is made and two estimates of the less precise width, $W_Z$, are made using different but equivalent maxima for each principal maximum. The tendency to overestimate the width of intense maxima and underestimate that of weak maxima is minimized by practicing making the same width fit simultaneously the first film relative to the second and the second film relative to the third, learning to use the reference intensity of the lighter film more critically. The d-spacing is calculated by Bragg's relation:

$$d = \lambda/2 \sin \theta \quad (1)$$

where $\lambda = 1.5418$ for CuK$\bar{\alpha}$ radiation and the Bragg angle $\theta$ is given by the camera geometry:

$$\tan 2\theta = \Delta Z/2r. \quad (2)$$

The specimen-to-film distance, r, is 50 mm. The measured diffraction width, $W_Z$, is corrected for instrumental broadening by Warren's method:

$$W^2 = W_Z^2 - \omega^2 \quad (3)$$

where $\omega^2 = 0.154$ mm$^2$ obtained from the line width of inorganic references. The peak width in degrees $2\theta$ is calculated from the camera geometry:

$$\beta 1/3.8 = 2\theta_D - 2\theta_C \quad (4)$$

where $$\tan 2\theta_D = (\Delta Z + W)/2r, \quad (5)$$

$$\tan 2\theta_C = (\Delta Z - W)/2r. \quad (6)$$

The peak width is converted to the average crystallite dimension in the associated crystallographic direction by Scherrer's relation:

$$D = K\lambda/\beta_{1/3.8} \cos \theta, \quad (7)$$

$$= 102.5/\beta_{1/3.8} \cos \theta, \quad (8)$$

in angstroms where $K = 1.16$ is adopted for the width at 1/3.8 height. The crystallite dimension is also calculated in terms of the number of crystallographic repeats, $$N = D/d. \quad (9)$$

In this fashion the average lateral crystallite dimensions in angstroms $D_{010}$, $D_{1\bar{1}0}$, and $D_{100}$ are obtained, and likewise the average longitudinal crystallite dimension $D_{\bar{1}03}$. In addition, the corresponding dimensions in crystallographic repeats are obtained (equation 9):

$N_{010}$, $N_{1\bar{1}0}$, $N_{100}$ and $N_{\bar{1}03}$.

The average length of the crystallites along the polymer chain direction, $l_c$ is estimated as $$l_c = \cos(c; d_{\bar{1}03})\, D_{\bar{1}03} \quad (10)$$

$$= 0.9408\, D_{\bar{1}03} \quad (11)$$

where $(c, d_{\bar{1}03})$ is the angle between the crystallographic c axis (the polymer chain direction) and the normal to the $\bar{1}03$ crystallographic planes. The average cross-sectional area of the crystallites, $A_c$, is estimated as $$A_c = N^2/a^*b^* \sin\gamma^* \quad (12)$$

$$= 20.37\, N^2 \quad (13)$$

where $N^2$ is the average product of the crystallographic repeats in two principal lateral directions; namely, $$N^2 = (N_{100}N_{010} + N_{100}N_{1\bar{1}0} + N_{010}N_{1\bar{1}0})/3. \quad (14)$$

$a^*$, $b^*$ are the reciprocal unit cell lattice vectors perpendicular to the c axis and $\gamma^*$ is the angle between them. Finally, the average crystallite volume, $V_c$, is calculated as the product of the length, $l_c$, and the cross-sectional area, $A_c$, specifically, $$V_c = l_c A_c \quad (15)$$

$$= 19.16\, D_{\bar{1}03}\, N^2 \quad (16)$$

Lamellar Skewness — Small Angle Pattern

The skewness of the lamellar layers and hence of the amorphous channels between them in textured fibers is determined from the small angle X-ray scattering patterns. Small angle X-ray diffraction photographs usually reveal four diffraction maxima (corresponding to second-order reflections) at the corners of a rectangle. The lateral spacing, $\Delta X$, and the longitudinal spacing, $\Delta Y$, between equivalent scattering maxima are measured for the second order small angle diffraction maxima. The lamellar skewness or the crystallite skewness angle, $\alpha$, is calculated as $$\alpha = \arctan(\Delta X/\Delta Y). \quad (17)$$

In cases where the maxima overlap laterally the value of $\Delta X$ beyond which the intensity of the scattering perceptably decreases is adopted. The second order maxima are usually the dominant small angle X-ray maxima, often the only ones observed; in any case they correspond to a Bragg spacing which is approximately equal to the average longitudinal crystallite dimension, $D_{\overline{103}}$, that is, a small angle Bragg spacing of less than 190 Å.

We claim:

1. A process for making a deep-dyeing polyester yarn, comprising the steps of:
   a. texturing a polyester feed yarn having less than 30% shrinkage, an elongation greater than 10% and less than 80%, and a stress-induced crystalline structure having an average crystallite volume of at least $4 \times 10^5$ cubic angstroms and an average lateral minimum dimension as determined by X-ray diffraction of more than 45 angstroms, said step of texturing comprising heat-setting of said feed yarn at a temperature above 170° C. and below the melt point of said feed yarn while said feed yarn is deformed into a non-rectilinear configuration, and
   b. collecting the resulting textured yarn in an orderly fashion.

2. The process defined in claim 1, wherein said step of texturing comprises drawing while false-twist heat-setting said yarn.

3. The process defined in claim 2, wherein the temperature of heat-setting is between 180° C. and 245° C.

4. The process defined in claim 1, wherein said feed yarn has a shrinkage less than 10%.

5. The process defined in claim 1, wherein said feed yarn has a longitudinal crystallite dimension in the 103 direction of at least 100 angstroms.

6. A deep-dyeing textured polyester yarn having a crystallite skewness angle between 5° and 35°.

7. A yarn as defined in claim 6, wherein said yarn is a false-twist heat-set yarn.

8. A yarn as defined in claim 6, wherein said skewness angle is between 20° and 30°.

9. A yarn as defined in claim 7, wherein said skewness angle is between 20° and 30°.

* * * * *